US005271167A

United States Patent [19]

Smith

[11] Patent Number: 5,271,167

[45] Date of Patent: Dec. 21, 1993

[54] MEANS FOR BLOCKING FLOW OF MATERIAL FROM SCRAPER BOWL

[75] Inventor: Jerry F. Smith, Pekin, Ill.

[73] Assignee: Caterpillar Inc., Peoria, Ill.

[21] Appl. No.: 937,004

[22] Filed: Aug. 31, 1992

[51] Int. Cl.[5] ..... E02F 3/65

[52] U.S. Cl. ..... 37/423; 37/424

[58] Field of Search ..... 37/4, 8, 126 A-126 AE, 37/129

[56] References Cited

U.S. PATENT DOCUMENTS

| | | | |
|---|---|---|---|
| 2,791,044 | 5/1957 | Hanroch | 37/8 |
| 3,303,587 | 2/1967 | Rockwell | 37/8 |
| 3,343,286 | 9/1967 | Ray, Jr. et al. | 37/8 |
| 3,748,759 | 7/1973 | Liess | 37/8 |
| 3,934,361 | 1/1976 | Johnson et al. | 37/8 |
| 4,294,026 | 10/1981 | Welch | 37/8 |

*Primary Examiner*—Randolph A. Reese
*Assistant Examiner*—Arlen L. Olsen
*Attorney, Agent, or Firm*—Calvin E. Glastetter

[57] ABSTRACT

Elevating scrapers are useful for loading material into a bowl and transporting the material to a location for dumping. When the elevator loads material into the bowl, a portion tends to slide forward between the side walls and the elevator and out of the bowl. The subject arrangement provides a blocking plate attached to the side wall which extends toward the elevator. The blocking plate blocks the reverse flow of material between the side wall and the elevator. This arrangement of components reduces the amount of time needed to load the material into the bowl.

7 Claims, 2 Drawing Sheets

MEANS FOR BLOCKING FLOW OF MATERIAL FROM SCRAPER BOWL

TECHNICAL FIELD

This invention relates generally to a scraper having an elevator for loading material rearwardly and upwardly into a bowl and more particularly to a means for blocking the reverse flow of the material out of the bowl between the elevator and the bowl side.

BACKGROUND ART

Elevating scrapers are used to remove and transport large volumes of material from one location to another. A cutting edge in the scraper bowl is pulled through the material to loosen the material, and a powered elevator carries the material away from the cutting edge rearwardly and upwardly into the bowl. One of the problems associated with the elevator loading the material into the bowl is that a pile of material will develop behind the elevator in the bowl. As the elevator continues to move material rearwardly and upwardly onto and over the pile, a portion of the material will move or slide forwardly from the pile through an opening between the bowl side and the elevator frame, and will fall out of the bowl. This movement of material out of the bowl will increase the loading time of the scraper.

The present invention is directed to overcoming one or more of the problems as set forth above.

DISCLOSURE OF THE INVENTION

In one aspect of an earthworking scraper of the present invention, a frame pivotally carries a material receiving bowl. The bowl has two generally vertical spaced parallel side walls and a cutting edge attached between the side walls at the forward opening of the bowl. An elevator is positioned at the forward opening of the bowl above the cutting edge and between the spaced side wall. A pair of elevator linkage members attach the elevator to the side walls. Means is provided for blocking reverse flow of material from the bowl between the side wall and the elevator The present invention provides an earthworking scraper arrangement which blocks the reverse flow of material from the bowl between the side wall and the elevator. The arrangement includes a plate attached to the bowl side which extends toward the elevator to block the flow of material out of the bowl.

BEST MODE FOR CARRYING OUT THE INVENTION

Figure 1:
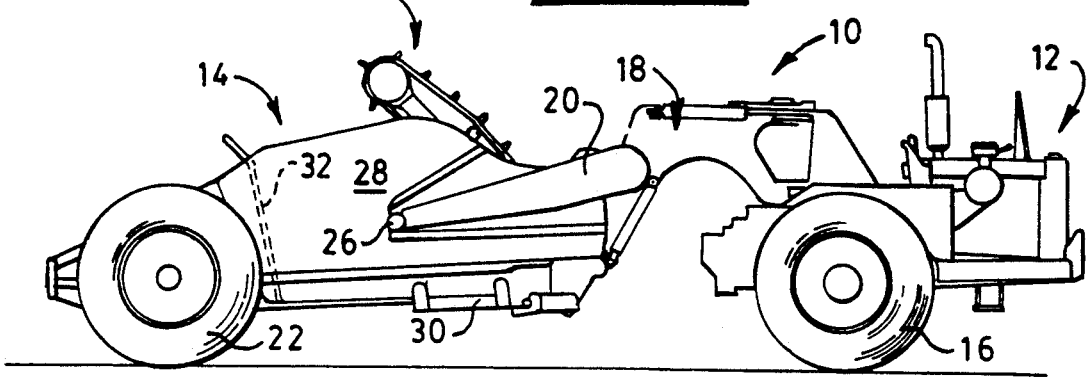
FIG. 1 is a side view of a scraper having an elevator to load material.
Figure 2:
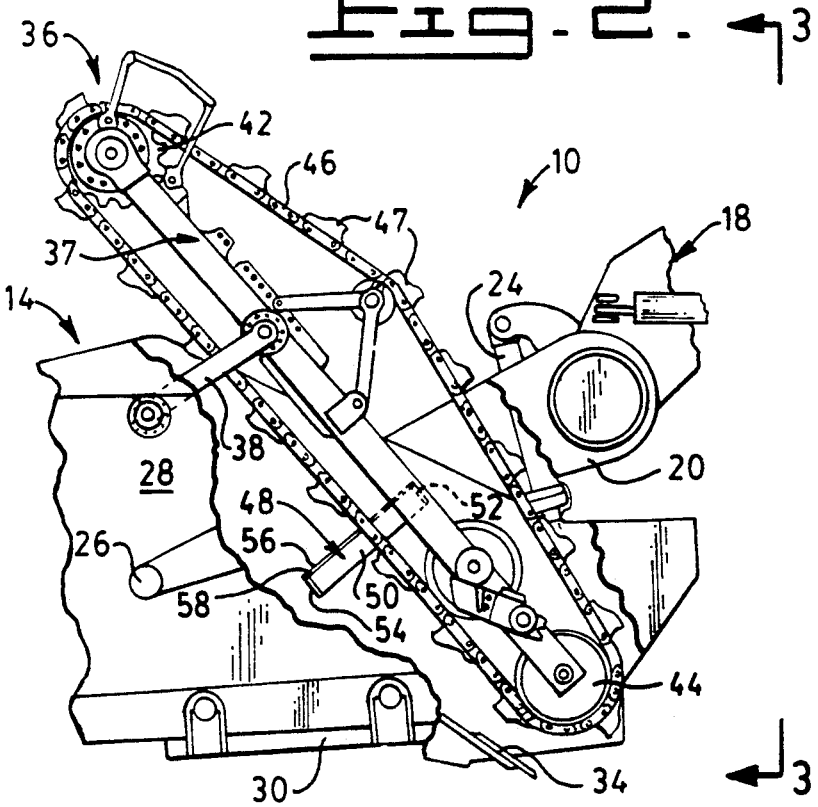
FIG. 2 is an enlarged side view of the scraper having portions broken away to show the present invention attached to the side wall of the scraper bowl.
Figure 3:
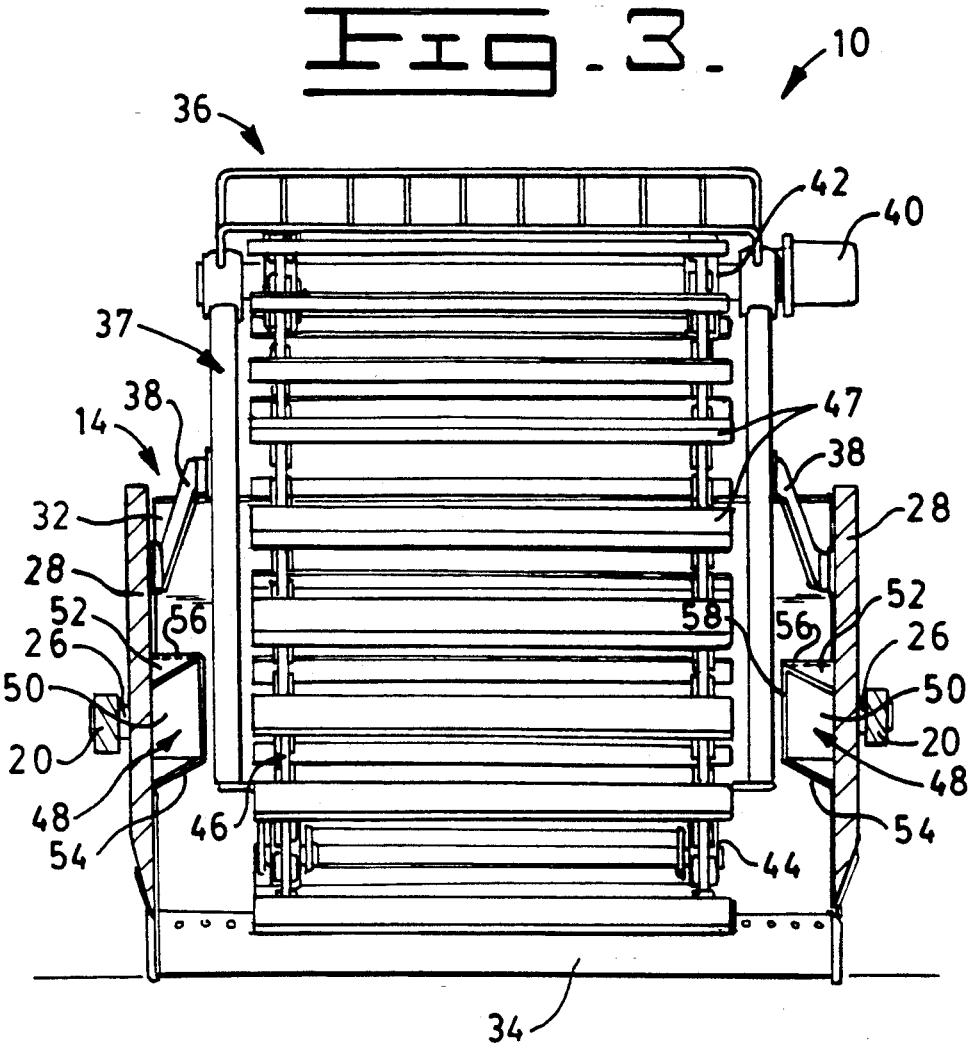
FIG. 3 is a view shown by line 3—3 in FIG. 1 showing the present invention.

Referring to FIG. 1, a scraper is generally indicated by reference number 10. The scraper includes a tractor 12 and a material receiving bowl 14. The tractor 12 includes a pair of ground engaging wheels 16, a frame 18, and a pair of spaced rearwardly projecting draft arms 20 which pivotally support the bowl 14 relative to the tractor 12. The bowl 14 has a pair of ground engaging wheels 22 which support the bowl 14. A pair of hydraulic cylinders 24 which are attached between the frame 18 and the bowl 14 vertically move the bowl 14 to pivot around a pair of pins 26 which attach the draft arms 20 to the bowl 14. The bowl 14 includes a pair of spaced parallel side walls 28, a moveable floor 30 for ejecting material, a rear wall 32, and a cutting edge 34 positioned and attached between the side walls 28 at the forward opening of the bowl 14. As shown in FIG. 3, an elevator 36 is positioned between the side walls 14 at the forward opening of the bowl 14. The elevator 36 carries material from the cutting edge 34 rearwardly and upwardly into the bowl 14. The elevator 36 includes a vertical frame 37 attached to each side wall 28 by a support linkage 38 A motor 40 with a drive sprocket 42 is attached to the upper end of the frame 36. A guide wheel 44 is attached to the lower end of the frame 36. An endless chain 46 is positioned around the sprocket 42 and the guide wheel 44. Flights 47 for carrying material into the bowl 14 are mounted along the chain 46 at essentially equally spaced intervals.

A blocking plate 48 is attached to each of the side walls 28 of the bowl 14. The plate 48 has a central portion 50, a first end portion 52 extending toward the cutting edge 34 perpendicular to the central portion 50, and a second end portion 54 extending toward the cutting edge 34 perpendicular to the central portion 50. The blocking plate 48 has a side 56 which is attached, by any suitable means such as welding, to the side wall 28, and extends therefrom toward the elevator 30. A distal portion 58 ends in close proximity to the elevator 30. The central portion 50 of the blocking plate 48 is approximately twenty-four inches in length and approximately ten inches in width. The first and second end portions 52,54 are each approximately six inches in length and form triangular section. When attached to the bowl wall 28 the first end portion 52 is parallel and aligned with the elevator frame 37 and extends perpendicular therefrom into the material receiving bowl.

Industrial Applicability

In use of the scraper 10 of the present invention, the hydraulic cylinders 24 are extended to pivot the bowl 14 around the pins 26 to engage the cutting edge 34 with material to be loaded. As the scraper 10 is pulled forward, the cutting edge 34 will cut material and move it upwardly toward the bowl 14. The elevator motor 40 rotates the chain 46 and flights 47 to move the material from the cutting edge 34 upwardly into the bowl 14. As material is moved upwardly into the bowl 14, a mound of material will form behind the elevator 36. As more material is deposited onto the mound a portion of the material will tend to slide forward toward the spaces between the side walls 28 and the elevator 36. The blocking plate 48 is mounted to the side wall 28 and extends toward the elevator 36, thus blocking the forward flow of material out of the bowl 14.

In view of the foregoing, it is readily apparent that the structure of the present invention provides a blocking plate which blocks the reverse flow of material from the bowl between the side walls and the elevator, thus reducing the amount of time needed to load the bowl.

Other aspects, objects and advantages of this invention can be obtained from a study of the drawings, the disclosure and the appended claims.

What is claimed is:

1. An earthworking scraper for loading and transporting material comprising:

a frame;

a material receiving bowl pivotally carried by the frame and having two generally vertical spaced parallel side walls, a cutting edge being attached between the side walls for loading material;

an elevator positioned within the bowl above the cutting edge to carry the material from the cutting edge rearwardly and upwardly into the bowl;

a pair of elevator linkage members, each adjacent to a side wall and attaching the elevator to the side wall; and means for blocking the reverse flow of material from the bowl between the side wall and the elevator, the blocking means includes a blocking plate rigidly affixed to at least to a lower portion of the side wall and the blocking plate extends from the side wall toward the elevator.

2. The earthworking scraper of claim 1 wherein the blocking plate is welded to the side wall and extends therefrom toward the elevator.

3. The earthworking scraper of claim 2 wherein the blocking plate includes a central portion, a first end portion extending toward the cutting edge perpendicular to the central portion and a second end portion extending toward the cutting edge perpendicular to the central portion

4. The earthworking scraper of claim 3 wherein the central portion of the blocking plate is approximately twenty-four inches in length

5. The earthworking scraper of claim 4 wherein each of the first and second end portions is approximately six inches in length and form a triangle.

6. The earthworking scraper of claim 5 wherein the blocking plate is approximately ten inches in width

7. The earthworking scraper of claim 6 wherein the first end portion of the blocking plate is parallel and aligned with the elevator frame and extends perpendicular therefrom into the material receiving bowl.

* * * * *